United States Patent [19]

Lundin

[11] 4,395,936

[45] Aug. 2, 1983

[54] DEVICE FOR AUTOMATIC TRANSFER OF ROUNDS

[75] Inventors: Lars Lundin; Rune Svanstrom, both of Karlskoga, Sweden

[73] Assignee: Aktiebolaget Bofors, Bofors, Sweden

[21] Appl. No.: 149,876

[22] Filed: May 14, 1980

[30] Foreign Application Priority Data

Jun. 7, 1979 [SE] Sweden ..... 7904948

[51] Int. Cl.[3] ..... F41F 9/04

[52] U.S. Cl. ..... 89/46

[58] Field of Search ..... 89/33 B, 36 K, 45, 46

[56] References Cited

U.S. PATENT DOCUMENTS 4,064,786 12/1977 Elwin ..... 89/46

4,092,900 6/1978 Hottinger et al. ..... 89/45

*Primary Examiner*—Stephen C. Bentley

*Attorney, Agent, or Firm*—Pollock, Vande Sande & Priddy

[57] ABSTRACT

A device for automatic transfer of rounds of ammunition is utilized for a large-calibre firearm, for instance for ships or the like. The firearm comprises a magazine arranged on its elevating mass, and the firearm is set at a predetermined elevation at the loading of the magazine. Rounds are conveyed from an ammunition store via the underside of the mounting to the top of the mounting. A laterally displaceable cassette is arranged to receive rounds fed to it in an infeed position, and in an outfeed position to transfer rounds to the magazine when this has assumed the loading position. For the transfer of rounds from the cassette to the magazine of the firearm the potential energy of the rounds is utilized, so that no special transferring means working in the magazine need be utilized for this transfer.

10 Claims, 7 Drawing Figures

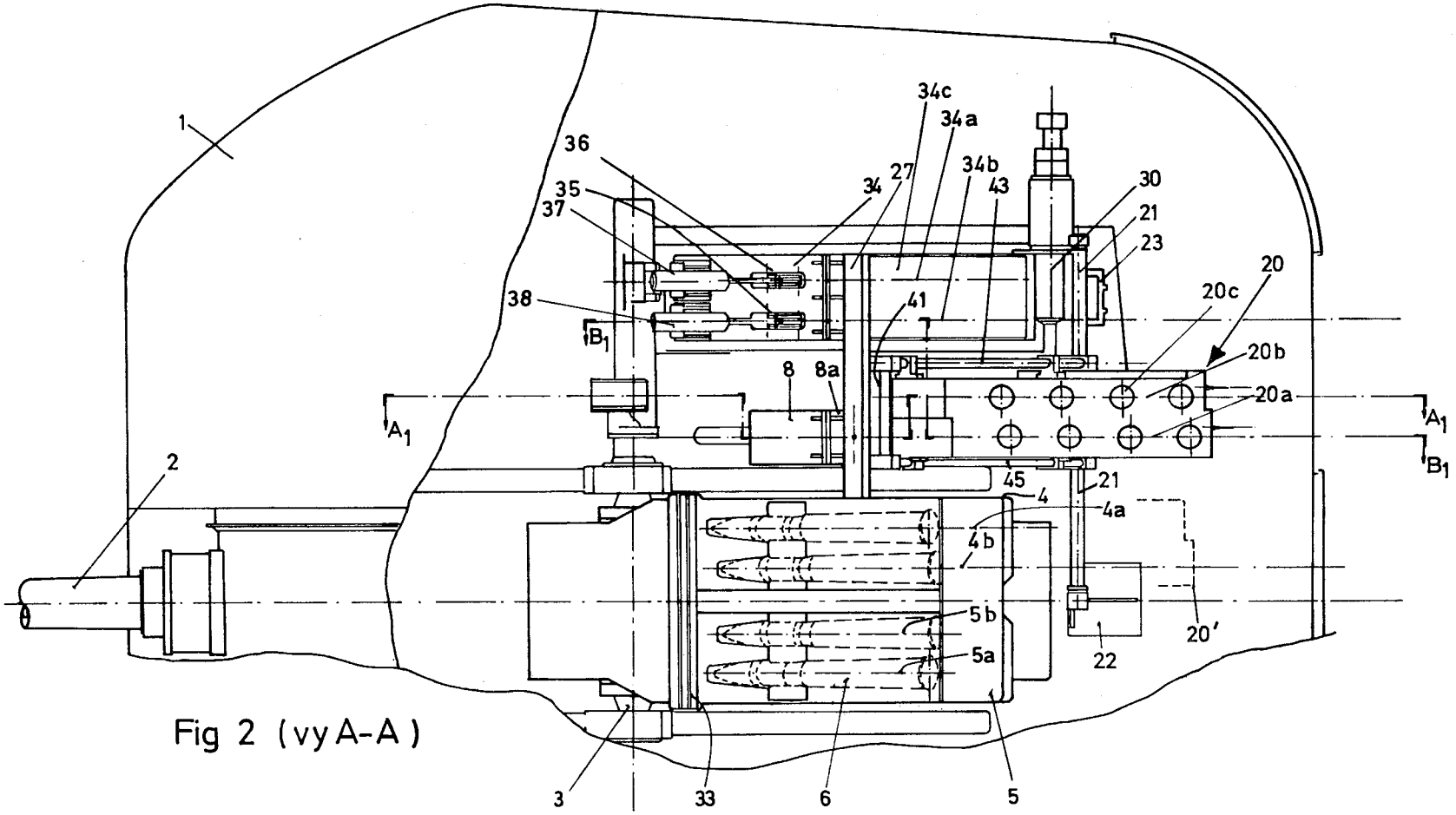
Fig 2 (vy A-A)

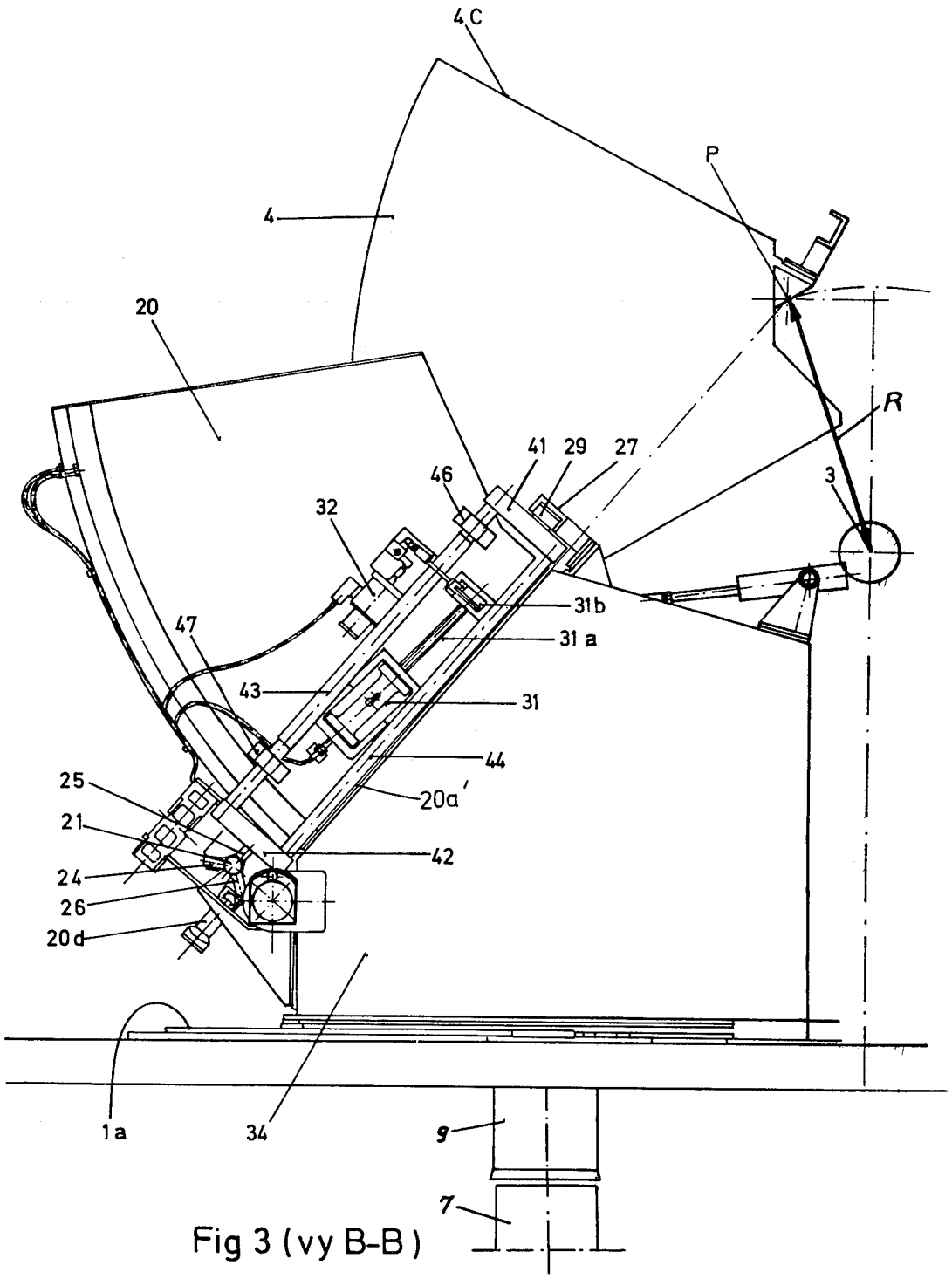
Fig 3 (vy B-B)

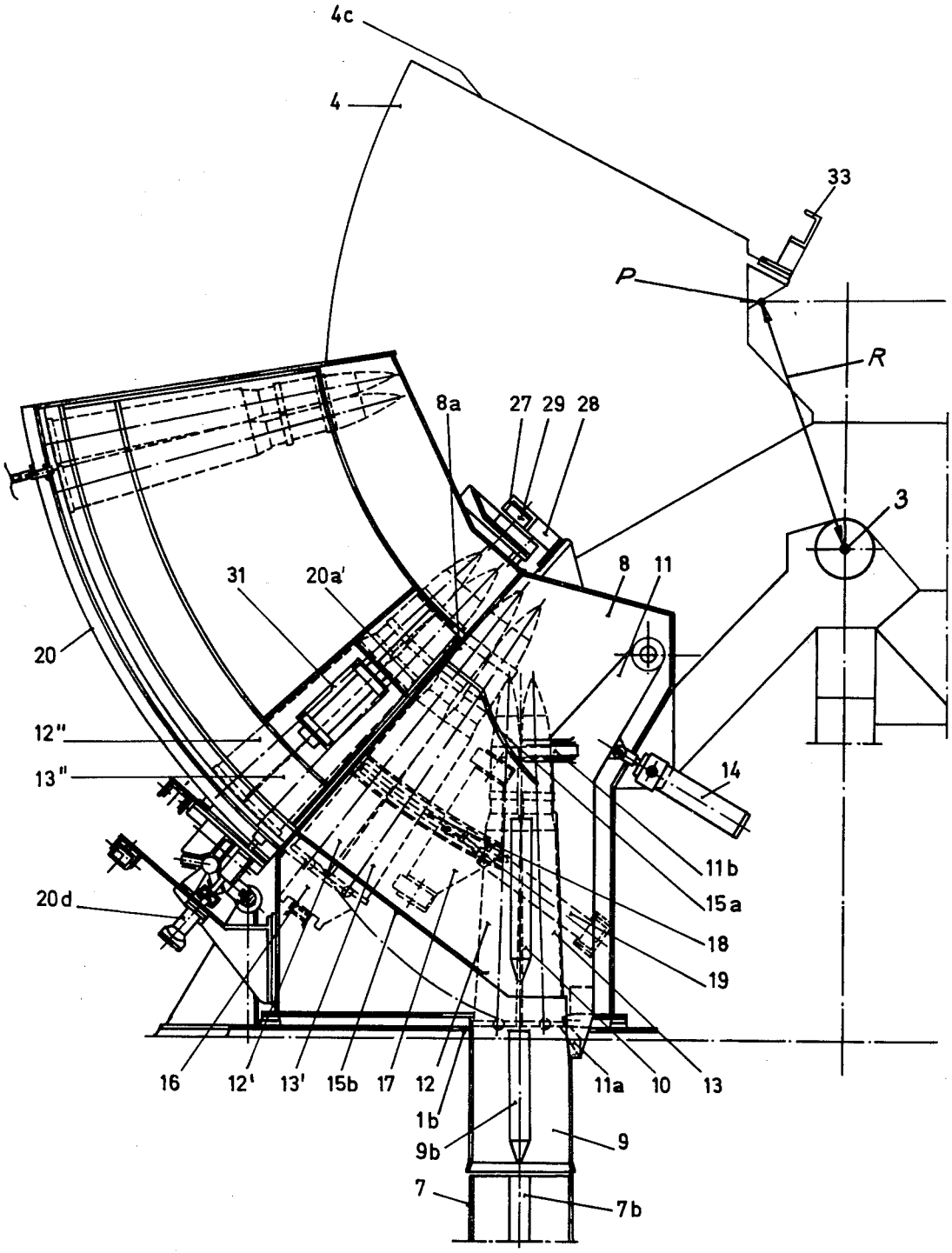
Fig. 4 (vy $A_1$-$A_1$)

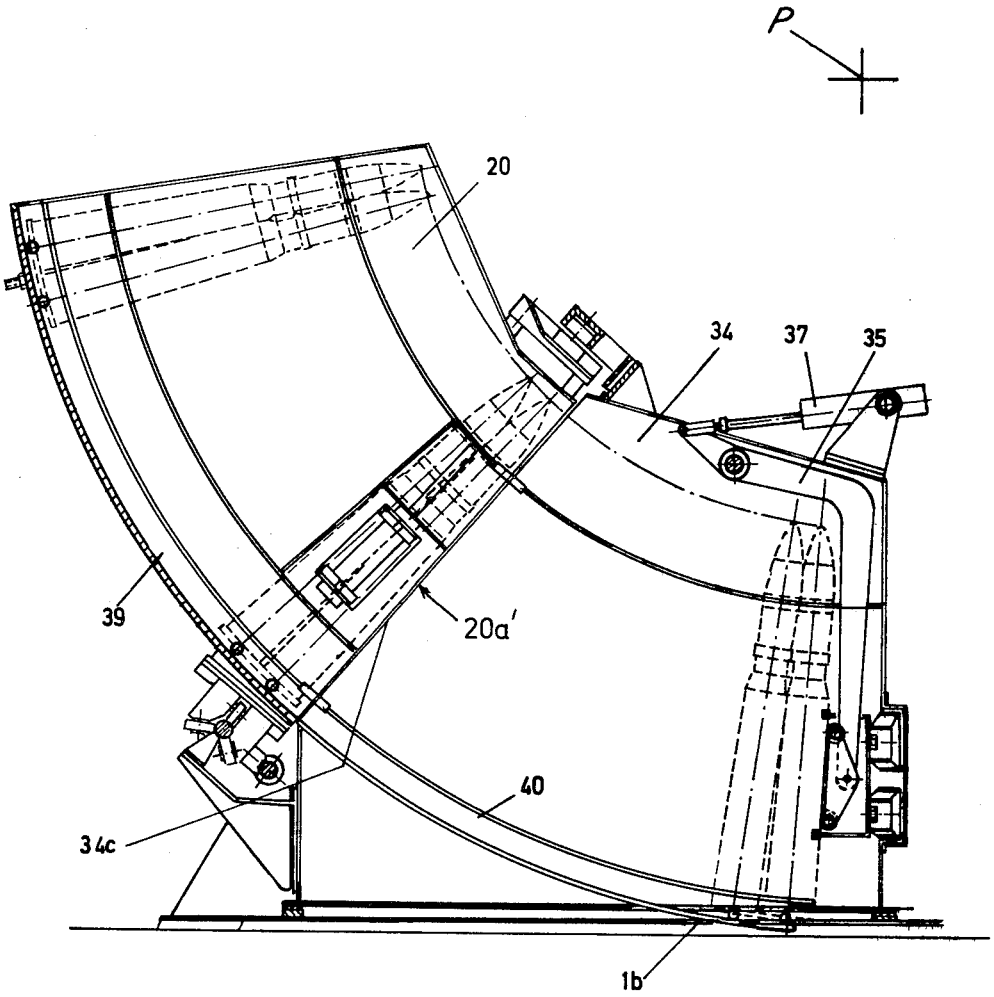
Fig.5 (vy $B_1$-$B_1$)

DEVICE FOR AUTOMATIC TRANSFER OF ROUNDS

TECHNICAL FIELD

The present invention relates to a device for automatic transfer of rounds of ammunition for an artillery piece comprising a firearm installed in a mounting, a magazine arranged at the elevating mass of the firearm, and a round feeding channel, for instance a hoist shaft, which leads from an ammunition store and via the underside of the mounting to the top of the mounting. The device then comprises a cassette for rounds which is displaceable between an infeed position and an outfeed position for the rounds. In said outfeed position the cassette is set with its outfeed opening facing an infeed opening of said magazine when the firearm assumes a predetermined elevation, so that the rounds can be transferred from the cassette to the magazine via said openings.

BACKGROUND ART

It is previously known in itself, for devices for transfer of rounds of the kind in question, to utilize displaceable cassettes for rounds which can be moved up to the magazine when the firearm is in a predetermined elevation.

It is also previously known, on ships, for instance, to utilize a large-calibre firearm and to feed ammunition from a main store under deck by means of one or a plurality of ammunition hoists, the hoist shafts or hoist drums of which are then usually arranged vertically. The platform of the mounting in question is moreover made with openings which when the firearm is in the loading position will be located above the ammunition hoists. For firearms and round transfer devices of said kinds, it has also been proposed to utilize manual transfer of rounds, to loaders then being stationed at the firearm and at various stages of firing having the assignment to transfer rounds fed from the hoists to ammunition racks which are used, and also to transfer rounds from said ammunition racks to the magazine of the firearm.

DISCLOSURE OF INVENTION

Technical Problem

For firearms of the kind mentioned, there is a desire, inter alia, to be able to automatize the transfer of rounds from the ammunition hoists to the magazine of the firearm. Said firearms are usually of the rapid fire type, and are located in comparatively limited spaces, and it can therefore, in various connections, be difficult to fulfil the desire for a technically well functioning and rapid automatized transfer of rounds. Said problems are also accentuated by the round transfer device of said kind having to fulfil the general requirements for simplicity of the technical embodiment, so that the installation and maintenance can be kept at a reasonable level.

Solution

According to the concept of the invention, a cassette should be utilized for the automatized transfer of rounds. Said cassette is then arranged displaceably in a direction substantially parallel to the axis of elevation of the firearm, and the cassette is moreover arranged in such a way in relation to the magazine of the firearm that it can be moved in over the magazine at a height level above the height level of the magazine. The potential energy which has been given to the rounds when they are fed into the cassette can then partly or entirely be utilized for the transfer of the rounds from the cassette to the magazine of the firearm.

In further developments of the concept of the invention, detailed designing measures are proposed for the structure of the cassette and its suspension in relation to the magazine in the firearm. Said further developments also include a so-called buffer magazine, into which rounds can be inserted from the cassette and vice versa. In further developments, the cassette arrangement has been doubled, so that the round transfer halves each serve a magazine of the firearm.

However, the feature that can mainly be considered to be characteristic for a device according to the invention will be noted from the characterizing part of the following claim 1.

Advantages

In addition to achieving the actual automatization of the transfer of rounds, a technically simple and compact structure is obtained which is suitable for use in limited space, for instance in gun turrets for artillery pieces for ships.

The round transfer device can be given a great capacity, and the storage of rounds in special buffer magazines makes loading of the magazine of the firearm possible without the firearm needing to be set in a predetermined traverse position on all occasions when loading is to take place.

As the potential energy is utilized for the transfer of rounds from the cassette to the magazine of the firearm, no special means for transfer of rounds which work with movements down in the magazine of the firearm need be used between the cassette and the magazine in question.

BRIEF DESCRIPTION OF DRAWINGS

An embodiment proposed at present of a device which has the characteristics significant for the invention will be described in the following, with reference to the accompanying drawings, in which FIG. 1 from the rear shows parts of a firearm arranged in a gun turret with the new device for automatized transfer of rounds between an ammunition hoist and the magazine of the firearm, FIG. 2 in a horizontal view (view A—A) shows the firearm and the devices according to FIG. 1, FIG. 3 is a side view (view B—B) shows the firearm and the device according to FIGS. 1 and 2, FIG. 4 shows parts according to the section line $A_1$—$A_1$ of the firearm and the device according to FIG. 2, FIG. 5 shows parts along the section line $B_1$—$B_1$ of the firearm and the device according to FIG. 2, FIG. 6*a* in a horizontal view shows a charger, which is known in itself, which is utilized for the device, and FIG. 6*b* in a side view shows the charger according to FIG. 6*a*.

BEST MODE OF CARRYING OUT THE INVENTION

Figure 1:
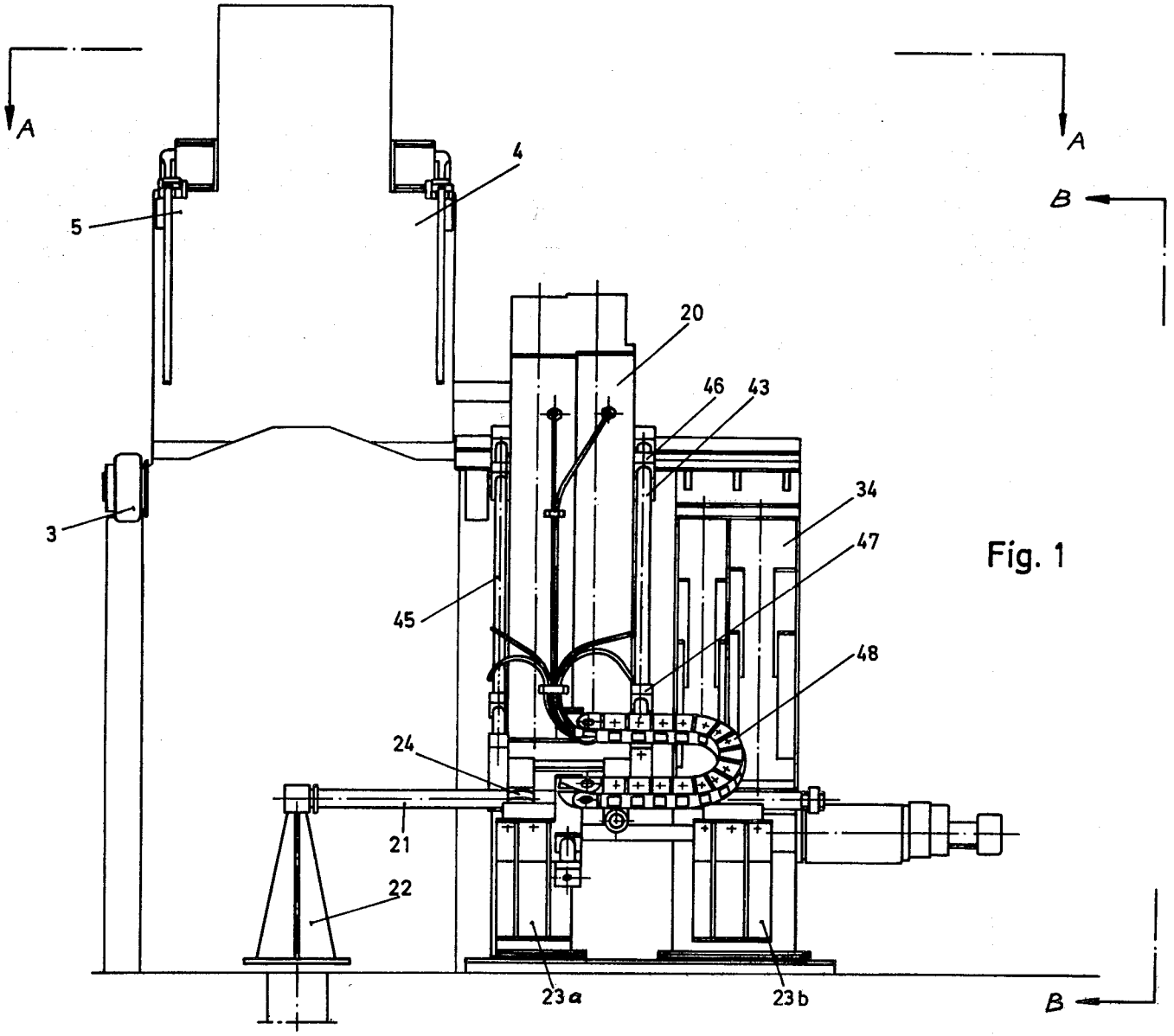

FIGS. 1–3 are intended to show the parts of an automatic gun, which is known in itself, for a ship, which the present invention concerns. A traversably arranged gun turret is indicated by the numeral 1. In the gun turret, a barrel 2 is arranged so that it can be elevated in a trunnion suspension 3. The firearm supports two magazines 4 and 5, fixed to its elevating mass and arranged symmetrically around the extension of the axis of the bore. Each magazine is made with two compartments which are indicated by 4*a*, 4*b*, and 5*a*, 5*b*, respectively. Each magazine compartment is made with an infeed opening for rounds, which infeed opening is located at the top 4*c* of each magazine. The infeed openings for all magazine compartments are mainly shown in FIG. 2, which shows that the tops in question are entirely open, so that rounds 6 can be inserted into the compartments via said open tops.

The platform 1*a* of the gun turret 1 can be set at a predetermined traverse position with two openings 1*b* in the platform over two ship-fixed hoist drums which are parallel to each other, and one of which is shown in FIG. 3, designated 7. In said hoist drums there are arranged ammunition hoists which are known in themselves, which from an ammunition store below deck transport the rounds in bunches of two and two up to the top of the platform. Each hoist drum is intended to serve its magazine, of the magazines 4 and 5, and as the device for automatic transfer of rounds is identical for each hoist drum, only one of them will be described in detail FIG. 4 as follows.

Over the opening 1*b* in question in the platform, which can be set in a predetermined traverse position of the gun over the hoist drum, a frame 8 is arranged, which at the bottom is provided with a drum 9 directed downwards through the opening 1*b* through which parts of rounds from the hoist can be inserted into the frame. In both the hoist drum 7 and the drum 9 the pairs of rounds are guided by longitudinal guide rails 7*b* and 9*b*. Also the frame has such a guide rail 10 on its inner wall.

Inside the frame there is arranged a pendulum 11 which is supported at its upper part in a way which is known in itself and which at its lower parts has first catch means 11*a* which can coact with a rear flange on one of the rounds in the pair of rounds which is inserted in the frame. In FIG. 4, two rounds standing on end, which have been inserted in the frame, are indicated by 12 and 13, and said first catch means 11*a* have caught around the rear flange of the round 13. Said first catch means comprise a part which can spring aside, in a way which is known in itself, which when the pair of rounds is inserted in the frame first springs aside and thereafter snaps out around the rear edge of the flange. The pair of rounds is held together also in a way which is known in itself by means of a charger which is described in the following.

Said pendulum 11 also comprises second catch means 11*b* which in the position shown of the rounds 12 and 13 grip the front parts of the round 13. The pendulum is actuated by means of a hydraulic cylinder 14. From a fetching position according to the positions of the rounds 12 and 13 the pendulum can thus swing upwards to the position of the rounds which is indicated by 12' and 13'. During this movement, the rounds are guided laterally by two guide plates 15*a* and 15*b* located on the inside of the frame. A flap 16 engages the charger which holds the pair of rounds together at the lower ends of the rounds. The flap retains the rounds in the positions indicated by 12' and 13' when the pendulum is swung back by the cylinder 14 to the fetching position to fetch a new pair of rounds. A pushing unit 17 which can be guided in a guide slot 18 in the wall of the frame is arranged at the inner walls in question of the frame. The actuating movement of the unit is achieved by means of a hydraulic cylinder 19. The guide rail 10 is arranged so that it can spring aside in order to permit the pair of rounds to be swung up by means of the pendulum. When the pendulum is in its lower position, the guide rail is locked by the pendulum, and can spring aside only when the pendulum has started to swing up.

The frame 8 has an opening 8*a* which is set obilquely and which is directed obliquely upwards. Said opening serves as an outfeed opening via which the pair of round 12' and 13' are pushed out of the frame by the unit 17.

The new device for transfer of rounds also comprises a cassette 20, to which the pair of rounds fed out from the frame 8 can be transferred. The cassette is inter alia supported on a guide 21 (shown in FIGS. 1–3), which is arranged in brackets 22, 23 so that it extends parallel to the trunnion axis. At its underside the cassette is supported on the guide 21 via two groups of wheels arranged at a distance from each other, which respectively have three wheels 24, 25, 26 which can coact with the guide and which are arranged with a spacing between the wheels of 120°.

At the top, the cassette is also supported in a guide beam 27 arranged on a frame part 28. The cassette is guided in said guide beam via guide rollers 29 or corresponding slide facilitating means. Also the guide beam 27 extends parallel to the trunnion axis. Through the arrangement described above, the cassette will be displaceable laterally between an infeed position for rounds at the frame and an outfeed position for rounds at the magazine 4.

Said cassette is made with two compartments, which are indicated by 20*a* and 20*b* in FIG. 2. For each compartment, the cassette has an obliquely set combination infeed and outfeed opening 20*a'* for rounds, directed downwards. In FIGS. 2, 3, and 4 the compartment 20*a* is shown set in the infeed position of the cassette at the frame 8. When the compartment 20*a* is partly or entirely filled with rounds, the cassette can be displaced laterally so that the compartment 20*b* will come into the infeed position at the frame, i.e. the position 20*a* has in FIG. 2. The lateral displacement of the cassette is accomplished by means of a hydraulic cylinder 30, the piston of which can coact with one side wall of the cassette. In the infeed position, the combination infeed and outfeed opening on the underside of the cassette is set facing the outfeed opening 8*a* in the frame so that the rounds 12' and 13' can be pushed into the cassette by the unit 17 to the positions shown by 12'' and 13''.

On the inside of the cassette, for each cassette compartment, there are arranged blocking means 31 which prevent the rounds 12'' and 13'' from slipping out of the cassette when the unit 17 returns to prepare for pushing out a new pair of rounds. The blocking means are made in the form of star wheels with which the rounds 12'' and 13'' pushed out into the cassette can coact. There is a shaft 31*a* running from the star wheels which supports a ratchet wheel 31*b* which coacts with a spring-loaded pawl in such a way that the ratchet wheel can rotate in one direction only. The pawl can be released by means of an electromagnet 32, and the ratchet wheel is then also permitted to rotate in the other direction of movement.

By means of said electromagnet 32 the emptying of rounds from the cassette when this is set in the outfeed position at the magazine 4 is determined. The electromagnet can then be pulse controlled so that, for instance, it permits the release of one pair of rounds for each pulse. Each cassette compartment holds 5 pairs of rounds, i.e. a total of 10 rounds, and the entire compartment will thus be emptied with five pulses.

The cassette is movable to its outfeed position at the magazine 4 when the firearm assumes a predetermined elevation. Said predetermined elevation is obtained in the example of the embodiment when the firearm is given the maximum elevation of 77°. In the figures, the barrel has the elevation 0°. When the magazine 4 swings in to its loading position, a point P of the magazine will swing around the trunnion axis at the radial distance R. In the feeding position of the magazine the infeed openings of the magazine will be in the same plane as the outfeed opening 8*a* of the frame 8, i.e. in FIGS. 3 and 4 the magazine 4 has a position corresponding to the position of the frame 8. On its top, the magazine supports a guide beam part 33 which in the loading position of the magazine has its end connected with said guide beam 27 so that the cassette can be moved over the magazine compartments, guided by said guide beam part. The lateral displacement can then be done in such a way that the two compartments in the cassette are each set facing its magazine compartment, or so that an arbitrary cassette compartment is set over an arbitrary magazine compartment, which latter alternative gives a greater choice when filling the compartments of the magazines with different kinds of ammunition. In FIG. 2, the first-mentioned alternative with the cassette compartments located each over its magazine compartment has been indicated by 20'. In FIG. 2 also the top of the cassette has been shown, which top is made with eight inspection holes 20*c*.

The device for automatic transfer of rounds also comprises a buffer magazine 34, shown in FIGS. 2 and 5, which is located outside the frame 8, counted from the firearm. Also the buffer magazine is made with two compartments, which in FIG. 2 are symbolized by 34*a* and 34*b*, and each of which hold ten rounds or five pairs of rounds. Also the buffer magazine is made with combination infeed and outfeed openings 34*c* for said compartments, which infeed and outfeed openings are set obliquely and are directed obliquely upwards in the corresponding way and with the same position as the outfeed opening 8*a* of the frame. The guide 21 and the guide beam 27 extend over the buffer magazine so that the cassette can be displaced laterally over the compartments 34*a*, 34*b* of the buffer magazine, and the cassette compartments can then each be set over its buffer magazine compartment at one and the same time, or a cassette compartment chosen can be set over a buffer magazine compartment chosen. When the cassette is set over the buffer magazine, the obliquely set combination infeed and outfeed openings on the underside of the cassette are opposite the obliquely upwards directed combination infeed and outfeed openings of the buffer magazine.

On the inside of the buffer magazine 34 there is a pendulum 35 and 36, respectively, for each compartment. Said pendulum is supported at its upper parts in the corresponding way as the pendulum 11 in the frame 8. These pendulums can also be swung with the aid of hydraulic cylinders 37 and 38, respectively.

The cassette 20, the buffer magazine 34, and the magazine 4 of the firearm are made with internal guide ways for the pairs of rounds, of which guide ways those for the cassette and the buffer magazine are shown by 39 and 40. Said guide ways coact with the chargers for the respective pairs of rounds, and enable the pairs of rounds to be displaced easily inside the cassette and the magazine in question. Such guide functions are well known in themselves, and therefore will not be described in more detail.

Said guide ways also involve that rounds transferred from the frame can be transferred to the buffer magazine with the aid of the potential energy which the rounds have received in connection with the transfer from the frame to the cassette. At the release of the blocking means 31 described above, the pairs of rounds will slide down into the buffer magazine with the aid of the potential energy, so that they will be in contact with the pendulums 35, 36, respectively, in the buffer magazine compartments. Conversely, when the cassette is to fetch rounds from the buffer magazine, the rounds are pushed up into the cassette with the aid of the pendulums 35, 36, in the corresponding way as at the transfer from the frame 8 to the cassette. The pendulums 35, 36, respectively, are then made in such a way that also the last pair of rounds can be pushed into the cassette without any special pushing unit corresponding to the unit 17.

Since the pairs of rounds are held together in the charger, and it must be possible to release this in the magazine of the firearm in connection with the firing, the rounds in the magazine compartments must be somewhat displaced in relation to each other. See FIG. 2, in which it is shown how the rounds 6 in the pairs of compartments 4*a*, 4*b* and 5*a*, 5*b*, respectively, are displaced in relation to each other.

This involves that the cassette must carry its rounds displaced in relation to each other in the two compartments 20*a*, 20*b*, in the corresponding way, which in turn involves that the cassette must be displaceable longitudinally, so that it can assume different longitudinal displacement positions in relation to the outfeed opening of the frame 8. For this purpose, the cassette is supported in a frame which, in turn, is displaceable laterally with the cassette, in accordance with what is described above. Said frame supports end parts 41 and 42 which support the slide facilitating means 29 and 24, 25, 26, respectively, described above. On either side of the cassette, the frame is provided with two longitudinal side parts 43, 44, 45. On either side, the cassette is supported on the upper side parts 43 and 45, respectively, on each side, via clamps 46 and 47, which are fastened to the outsides of the side walls of the cassettes, and which permit the longitudinal displacement movements of the cassette in relation to the frame. At their ends, said upper side parts 43, 45 have narrowed sections, via which the coaction with the clamps 46, 47 takes place. The longitudinal displacement of the cassette takes place via a hydraulic cylinder 20*d*, the piston of which can coact with the cassette.

Further, the cassettes and the magazines are made with sensing means, not specially shown, which sense the number of rounds and the positions of the rounds in the cassettes and the magazines. In order that it shall be possible to install control and sensing conductors on the movable cassette, this is connected to a protective cover 48, composed of links which are movable in relation to each other, which protects said conductors from mechanical damage, for instance wear when the cassette is carrying out its lateral movement.

Figure 6A:
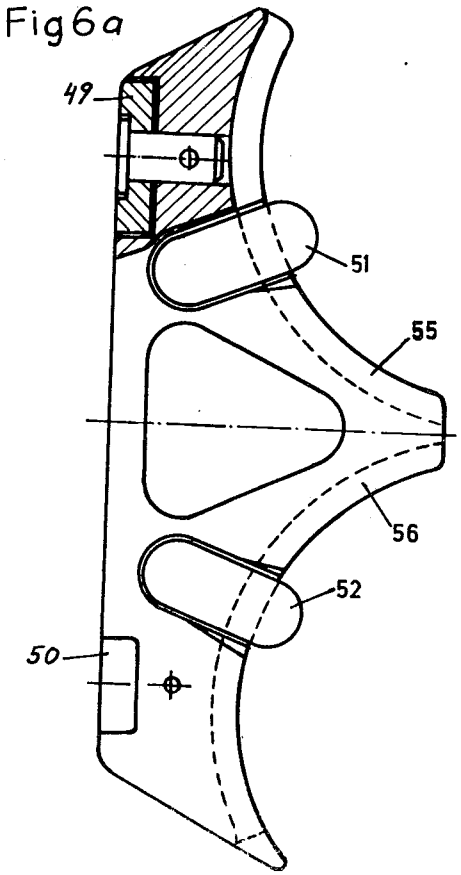
Figure 6B:
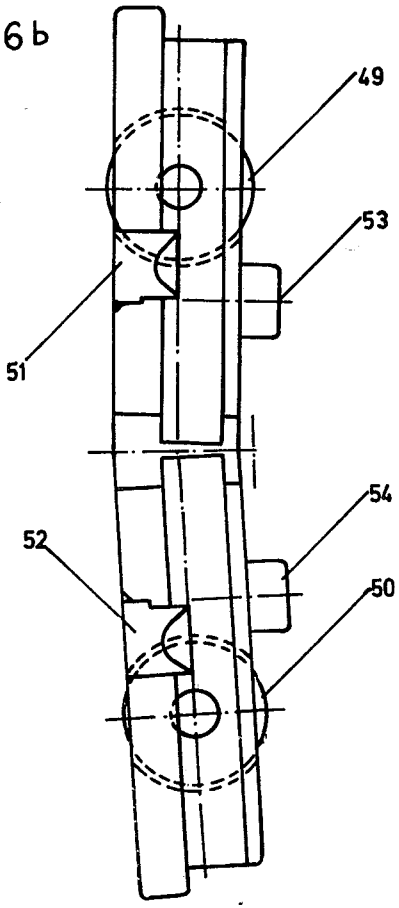

FIGS. 6*a* and 6*b* show a previously well known charger which can be used for the new device, for two 57 mm rounds. The charger is made with rollers 49 and 50, via which the charger coacts with guide ways 39, 40, in the cassettes and the magazines. The charger is made with catch means 51, 52, which can be actuated, and which coact with grooves in the rear flange of the respective round. The charger also has releasing devices 53, 54, which are actuated in the magazines of the firearm in connection with the firing, so that the rounds are released from the charger and this can be ejected in a way which is known in itself, in connection with the firing. In addition to the catch means 51, 52, the charger coacts with the respective rounds via guide edges 55 and 56.

BRIEF DESCRIPTION OF FUNCTIONING

The cassette is assumed to be in the infeed position at the frame 8 with one of its cassette compartments, and the firearm is in a predetermined traverse position where the hoist drum is uncovered via the openings 1*b* in the platform 1*a*. The pairs of rounds are conveyed up from the ammunition store below deck via the ammunition hoists which are known in themselves in the hoist drums 7 to the frame 8. The pendulum 11 of the frame swings up the respective pairs of rounds to the outfeed opening of the frame, from where the unit 17 pushes in the respective pairs of rounds into the cassette compartment in question. When the cassette compartment in question is partly or entirely filled, the cassette is actuated in the lateral direction and the longitudinal direction so that its second compartment comes into a position for filling of rounds. The cassette can thereafter be displaced to the position over the firearm which is then elevated so that its magazine 4 is in the loading position, after which the number of rounds desired can be transferred to the magazine compartments with the aid of the potential energy given to the rounds at the transfer from the frame. Alternatively, the cassette can be displaced laterally to the position over the buffer magazine 34, to which the rounds can be transferred from the cassette in the corresponding way as to the magazine of the firearm. After the transfer of rounds to any one of the magazines 4 or 5, the cassette can be displaced laterally for fetching of new rounds, so that before firing commences, both the magazines and the cassettes are filled with rounds.

After the magazine of the firearm has been partly or entirely emptied in connection with firing, the rounds remaining in the cassette can be transferred to the magazine of the firearm. At continuous firing, the cassette can fetch rounds from the buffer magazine and transfer these to the magazine of the firearm in a pause or pauses in the firing, which involves that the firearm need not return to the predetermined traverse position when the rounds in the magazine of the firearm and in the cassette have been consumed.

Through sensing of the rounds in question in the magazines and the cassettes, the cassettes can be controlled in dependence on the firing conditions, so that an optimized transfer of rounds can be obtained. Firing and feeding of ammunition of different kinds can also be carried out and controlled optimally. The new device for automatic transfer of rounds comprises two identical halves of the equipment on either side of the firearm, and said optimizing then also relates to co-ordinated control of the automatic transfer of rounds in the two halves.

The invention is not limited to the embodiment shown above as an example, but can be subject to modifications within the scope of the following claims. Thus, for instance, the number of compartments in the cassettes and the buffer magazines can be varied, and it is also possible to utilize more than one buffer magazine on each side. It is also possible to vary the design of the component units comprised in the new device, and possibly to install a round feeder in each cassette. Said feeder then works inside the cassette, and thus does not utilize the movements working in the magazine of the firearm.

INDUSTRIAL APPLICABILITY

The parts comprised in the new device for automatized transfer of rounds for the large-calibre firearm are easy to manufacture in an efficient manufacturing procedure at a factory and to integrate with the weapon equipment concerned, either for new equipment or for equipment already in service. Mounted on the weapon concerned, the new equipment functions without any modifications being required on already existing equipment.

I claim:

1. A device for automatic transfer of rounds for an artillery piece having a firearm installed in a mounting means, a magazine mounted on an elevating mass of the firearm, and a round feeding channel which leads from an ammunition store below the mounting to the top of the mounting, said device comprising a cassette means arranged displaceably between an infeed position for the rounds and an outfeed position, in which the cassette is set with an outfeed opening facing an infeed opening on said magazine when the firearm is in a predetermined elevation wherein the rounds can be transferred from the cassette means to the magazine via said openings, said cassette means being arranged displaceably in a direction substantially parallel to an axis of elevation of the firearm, said cassette means being arranged so that in said outfeed position it will be at a level higher than that of the magazine of the firearm so that a potential energy given to the rounds in the cassette means can be used for transfer of the rounds from the cassette means to the magazine.

2. A device according to claim 1, wherein said cassette means is arranged so that the outfeed opening of the cassette means also serves as the infeed opening of the cassette means to form a combination infeed and outfeed opening for the cassette means, said combination infeed and outfeed opening being set obliquely and located on the underside of the cassette.

3. A device according to claim 2, which further comprises a frame arranged at the infeed opening for rounds of the cassette means which are located above the mouth of the round feeding channel in the mounting means, said frame being arranged with an obliquely set outfeed opening directed upwards, wherein the combination infeed and outfeed opening of the cassette can be set to face in the infeed position of the cassette.

4. A device according to claim 3, which further comprises a pendulum applied in the frame which is arranged to grip the rounds from the round feeding channel as they are fed up into the frame and to swing the rounds to the outfeed opening of the frame.

5. A device according to claim 4, which further comprises a round actuating unit in the frame which displaces the rounds swung up by the pendulum to the outfeed opening of the frame into the cassette means set over the outfeed opening of the frame.

6. A device as claimed in claims 2, 3, 4, or 5 wherein said cassette means has a blocking means arranged to retain rounds which are inserted into the cassette means, said blocking means can be released in the outfeed position of the cassette above the magazine of the firearm.

7. A device as claimed in claims 2, 3, 4, or 5 which further comprises a buffer magazine with an obliquely set combination infeed and outfeed opening, said opening directed upwards, against which the cassette means can be set with its combination infeed and outfeed opening in alignment therewith so that the rounds can be transferred from the cassette means to the buffer magazine by means of the potential energy given to the rounds in the cassette means, and that the rounds can be transferred from the buffer magazine to the cassette means by means of a second pendulum means for the buffer magazine.

8. A device as claimed in claim 2 wherein the cassette means is arranged with two parallel compartments for rounds, said device also including an index means for setting individual compartments in the infeed and outfeed positions of the cassette means in relation to the frame.

9. A device as claimed in claims 2, 3, 4, or 5, wherein said cassette means is guided on first guide means extending parallel to the axis of elevation of the firearm said device also including a second guide means arranged at the upper parts of the magazine of the firearm which in said predetermined elevation of the firearm is in contact with its end against the end of the first guide means to enable a longitudinal displacement of the cassette.

10. A device according to claim 8, wherein the firearm has two magazines and two round feeding channels, each magazine and the round feeding channel belonging to it has a cassette, a frame, and a buffer magazine, said buffer magazines being located outside the frames, as seen from the firearm.

* * * * *